US008915188B2

(12) United States Patent
Le Breton et al.

(10) Patent No.: US 8,915,188 B2
(45) Date of Patent: Dec. 23, 2014

(54) SECURITY DETONATOR

(75) Inventors: Hervé Le Breton, Laloubere (FR); Nathalie Raffin-Barril, Andrest (FR); Didier Cazajous, Argeles Gazost (FR)

(73) Assignee: Nexter Munitions, Versailles (FR)

( * ) Notice: Subject to any disclaimer, the term of this patent is extended or adjusted under 35 U.S.C. 154(b) by 152 days.

(21) Appl. No.: 13/557,889

(22) Filed: Jul. 25, 2012

(65) Prior Publication Data

US 2014/0109787 A1 Apr. 24, 2014

(30) Foreign Application Priority Data

Aug. 1, 2011 (FR) ..... 11 02413

(51) Int. Cl.

| | |
|---|---|
| ***F42D 5/00*** | (2006.01) |
| ***F42B 3/10*** | (2006.01) |
| ***F42B 3/113*** | (2006.01) |
| ***C06C 7/00*** | (2006.01) |
| ***F42B 3/18*** | (2006.01) |

(52) U.S. Cl.

CPC ... *F42D 5/00* (2013.01); *C06C 7/00* (2013.01); *F42B 3/113* (2013.01); *F42B 3/18* (2013.01); *F42B 3/10* (2013.01)

USPC ..... 102/200; 102/201

(58) Field of Classification Search

CPC ..... F41A 3/113; F42B 3/10; F42B 3/18; F42D 5/00; C06C 7/00

USPC ..... 102/200, 201, 202.7, 204, 206, 275.11, 102/290

See application file for complete search history.

(56) References Cited

U.S. PATENT DOCUMENTS

| | | | | |
|---|---|---|---|---|
| 3,062,143 | A * | 11/1962 | Savitt et al. | 102/202.8 |
| 3,791,302 | A * | 2/1974 | McLeod | 102/201 |
| 4,312,271 | A | 1/1982 | Day et al. | |
| 4,365,558 | A | 12/1982 | Lippler et al. | |
| 4,602,565 | A * | 7/1986 | MacDonald et al. | 102/202.7 |
| 4,671,177 | A | 6/1987 | Mayville | |
| 4,766,812 | A | 8/1988 | Sauvestre | |
| 4,898,095 | A * | 2/1990 | Tasaki et al. | 102/201 |
| 4,907,509 | A | 3/1990 | Lieberman | |
| 5,029,528 | A * | 7/1991 | Paisley | 102/201 |
| 5,204,491 | A * | 4/1993 | Aureal et al. | 102/202.14 |
| 5,275,106 | A * | 1/1994 | Cutting et al. | 102/202.7 |
| 6,047,643 | A * | 4/2000 | Benner et al. | 102/201 |
| 6,487,971 | B1 * | 12/2002 | Anderson | 102/201 |

(Continued)

FOREIGN PATENT DOCUMENTS

| | | |
|---|---|---|
| EP | 1 306 643 A1 | 5/2003 |
| EP | 1 742 009 A1 | 1/2007 |

(Continued)

OTHER PUBLICATIONS

French Search Report issued in Application No. 1 102 413; Dated May 18, 2012 (With Translation).

*Primary Examiner* — Bret Hayes
(74) *Attorney, Agent, or Firm* — Oliff PLC

(57) ABSTRACT

A detonator includes a flying plate propelled by a squib stage including at least one first pyrotechnic composition and/or one first explosive, the plate being propelled onto a relay stage including at least one secondary explosive, wherein the detonator is provided with thermal insulation surrounding the squib stage for delaying the temperature rise thereof.

6 Claims, 2 Drawing Sheets

(56) References Cited

U.S. PATENT DOCUMENTS

| | | | | |
|---|---|---|---|---|
| 6,499,404 | B1 * | 12/2002 | Kern et al. | 102/201 |
| 6,539,868 | B1 * | 4/2003 | Moulard | 102/201 |
| 6,758,922 | B2 * | 7/2004 | Hamilton | 149/75 |
| 8,276,516 | B1 * | 10/2012 | Nance et al. | 102/275.11 |

FOREIGN PATENT DOCUMENTS

| | | | | |
|---|---|---|---|---|
| FR | 2 659 137 | A1 | 9/1991 | |
| FR | 2 692 346 | A1 | 12/1993 | |
| FR | 2 914 056 | A1 | 9/2008 | |
| GB | 2056633 | A * | 3/1981 | C06C 7/00 |

* cited by examiner

SECURITY DETONATOR

CROSS REFERENCE TO RELATED APPLICATIONS

Applicant claims priority under 35 U.S.C. 119 of French patent application no. 1102413 filed on Jan. 8, 2011.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

The invention belongs to the technical field of flying plate detonators or flyer detonators.

This type of detonator as described in U.S. Pat. No. 6,374,740 comprises a body in which is provided a first stage, or squib stage, comprising at least one first pyrotechnic composition or one deflagrant secondary explosive. Opposite to said first squib stage is provided a relay stage comprising at least one secondary explosive. The first composition may be initiated by optical means such as an optical fiber or electrical means (hot wire) while the secondary explosive may be initiated by a shock. This is why a thin plate (made of metal or plastic) is disposed between the two pyrotechnic stages. Following initiation on actuation of the first composition, the plate is propelled onto the secondary explosive which will then initiate as a result of the energy of the impact provided by the plate.

This operation has a disadvantage in terms of safety.

In case of exposure of the detonator to a strong heat due to a fire for example, the first composition might react and cause the propulsion of the plate and thereby the reaction of the secondary explosive and of the entire pyrotechnic chain.

To address this problem, the invention proposes to decrease the sensitivity to a temperature rise of the squib stage.

BRIEF SUMMARY OF THE INVENTION

Thus, an object of the invention is a detonator provided with a plate propelled by a squib stage comprising at least one first pyrotechnic composition and/or one first explosive, said plate being propelled onto a relay stage comprising at least one secondary explosive, wherein said detonator is provided with thermal insulation means surrounding the squib stage for delaying the temperature rise thereof.

According to one feature of the invention, the thermal insulation means is provided with an envelope made of a ceramic material.

According to another feature of the invention, the thermal insulation means is provided with an envelope made of a plastic or composite material.

Advantageously, the thermal insulation means associates an envelope made of a first thermal insulation material and closed by a plug made of a second thermal insulation material.

According to one feature of the invention, the one or more materials constituting the thermal insulation means exhibit a thermal conductivity of less than 0.24 $W \cdot m^{-1} \cdot K^{-1}$.

In this case, the thickness of the thermal insulation means will preferably be greater than 0.5 mm.

Advantageously, the first pyrotechnic composition or the first explosive of the squib stage is in contact with the end of an optical fiber.

BRIEF DESCRIPTION OF THE SEVERAL VIEWS OF THE DRAWING

The invention will be better understood from the following description, taken in conjunction with the appended drawings in which.

DETAILED DESCRIPTION OF THE INVENTION

Figure 1:
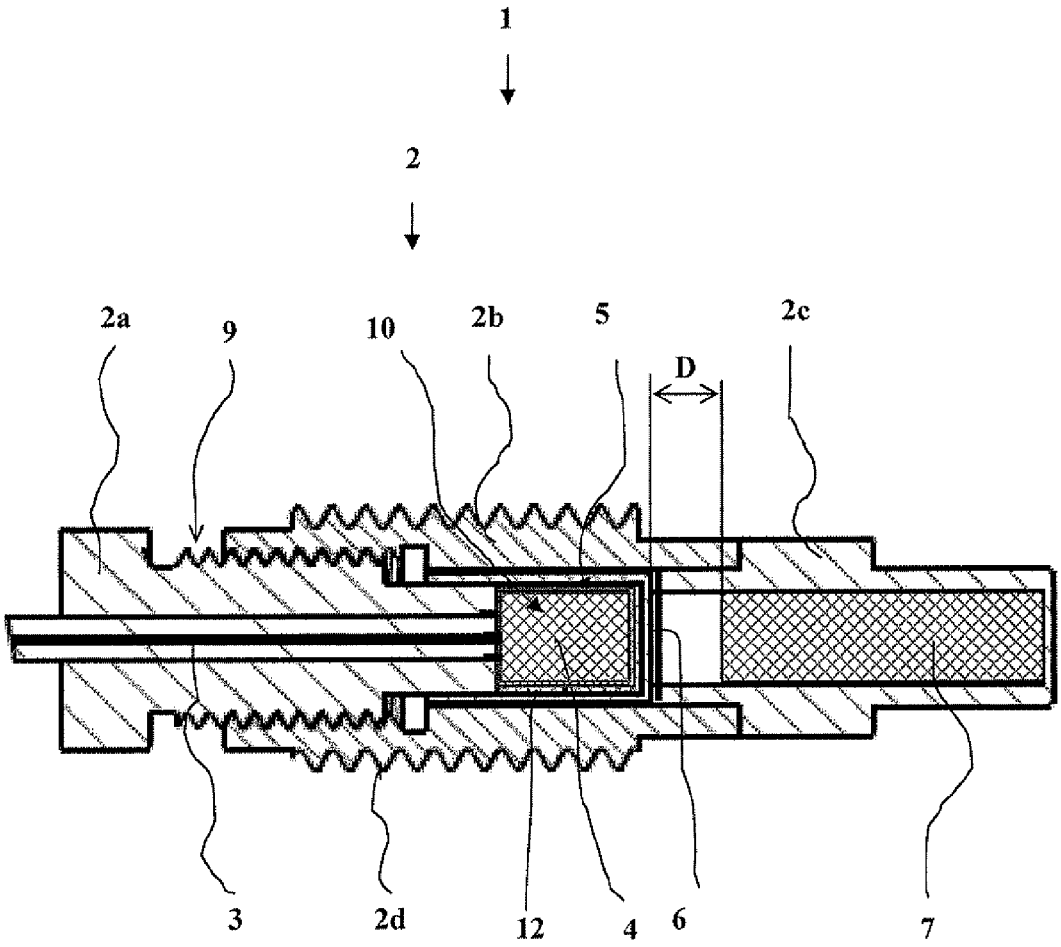
FIG. 1 is a view in longitudinal section of a detonator according to a first embodiment of the invention.

According to FIG. 1, a detonator 1 is provided with a substantially cylindrical body 2 comprising three parts 2*a*, 2*b* and 2*c*. The central part 2*b* of the body is provided with an outer thread 2*d* for securing the detonator with an assembly for receiving it such as an ammunition (assembly not shown).

Coaxially to the body 2, a sheathed optical fiber 3 passes through the rear part 2*a* of the body. The optical fiber 3 comes out into a squib stage 10 in contact with a photosensitive first pyrotechnic composition 4. Such an assembly of an optical fiber in contact with a pyrotechnic composition is described in French patent FR2914056.

As specified in said patent FR2914056, a composition associating zirconium and potassium perchlorate may be used as the first pyrotechnic composition 4. Such a composition is conventional and it is not necessary to describe it in further details. Other types of pyrotechnic compositions may be used such as: boron/potassium nitrate, boron/zirconium/potassium nitrate . . . .

The first pyrotechnic composition 4 may also be replaced by a secondary explosive able to adopt a deflagrant regime. The secondary explosive can be pure or incorporate an optical dopant as described in European patent EP1742009.

Preferably, an ignition pyrotechnic composition layer (such as a zirconium/potassium perchlorate composition) in contact with the optical fiber 3 will be associated at the squib stage 10, and said ignition pyrotechnic composition layer will ignite a layer of a deflagrant secondary explosive, for example octogen. European patent EP1306643 describes such an association of an ignition composition and a secondary explosive.

The key to ensure the optical ignition is to provide the squib stage 10 with a first composition (and/or a deflagrant secondary explosive) with a perfectly controlled and relatively reduced granulometry (less than or equal to 60 micrometers).

This first pyrotechnic composition is loaded into a casing 5 which is surrounded by thermal insulation means 12. This thermal insulation means 12 is provided with an envelope made of a ceramic, plastic or composite material. The plastic used may be for example a polyamide PA66-like thermoplastic.

A ceramic material may be for example silica-based and selected from ceramics with a high thermal resistance. Ceramic is preferred since, as a result of its porosity, its natural thermal insulation qualities are important.

The thus constituted squib stage is provided with a propellable metal plate 6 (also called in the present specification flyer/flying plate 6) placed on the ceramic coating outside thereof, opposite the optical fiber 3. Screwing the rear part 2*a* on the central part 2*b* allows to apply the bottom of the squib stage 10 (covered by the insulation means 12) against the plate 6 which is then clamped between the insulator 12 and the front part 2*c* of the body.

The squib stage is thus held in position thanks to a thread 9 securing the rear part 2*a* of the body to the central part 2*b* of the body. The metal plate 6 is supported by its periphery on a shoulder of the front part 2*c* of the body 2.

At a distance D from the propellable metal plate 6, in the front part 2*c* of the body is a shock-sensitive secondary explosive 7 which forms a relay stage. The distance D will be selected by the one skilled in the art as being the one for obtaining the optimum propulsion velocity for shock-triggering the secondary explosive 7 by virtue of the characteristics of the squib stage 10, thus in particular of the nature and the mass of the first composition 4 and of the mass of the plate 6 and that of the insulation means 12.

The operation of the detonator is as follows:

A light beam is routed by the optical fiber 3 to the first pyrotechnic composition 4 (squib stage). The latter reacts by deflagrating, causing the propulsion of the propellable metal plate 6 towards the secondary explosive 7 (relay stage). The shock then causes the detonation of the latter which causes the reaction of the rest of the pyrotechnic chain (pyrotechnic chain not shown) associated to the assembly receiving the detonator.

To ensure its safety function in case of an important temperature rise, the invention proposes the squib stage 10 to be sufficiently thermally insulated by the thermal insulation means 12 so that it is protected from heat or so that it burns or deflagrates only after the secondary explosive 7 of the front part 2*c* of the detonator 1 has itself burned or deflagrated.

To define the thermal insulation means, the one skilled in the art will consider the following parameters:

The temperature rise rate.

It is in the order of 150° C./minute during a fire.

The thermal resistance of the insulation means.

The thermal resistance is less than or equal to 0.24 $W \cdot m^{-1} \cdot K^{-1}$ (Watts per meter and per Kelvin) for PA66 plastic.

The degradation time of the pyrotechnic compositions and their minimum degradation temperature.

In order for the above-mentioned compositions to thermally degrade, it takes less than 30 seconds at 230° C.

Figure 2:
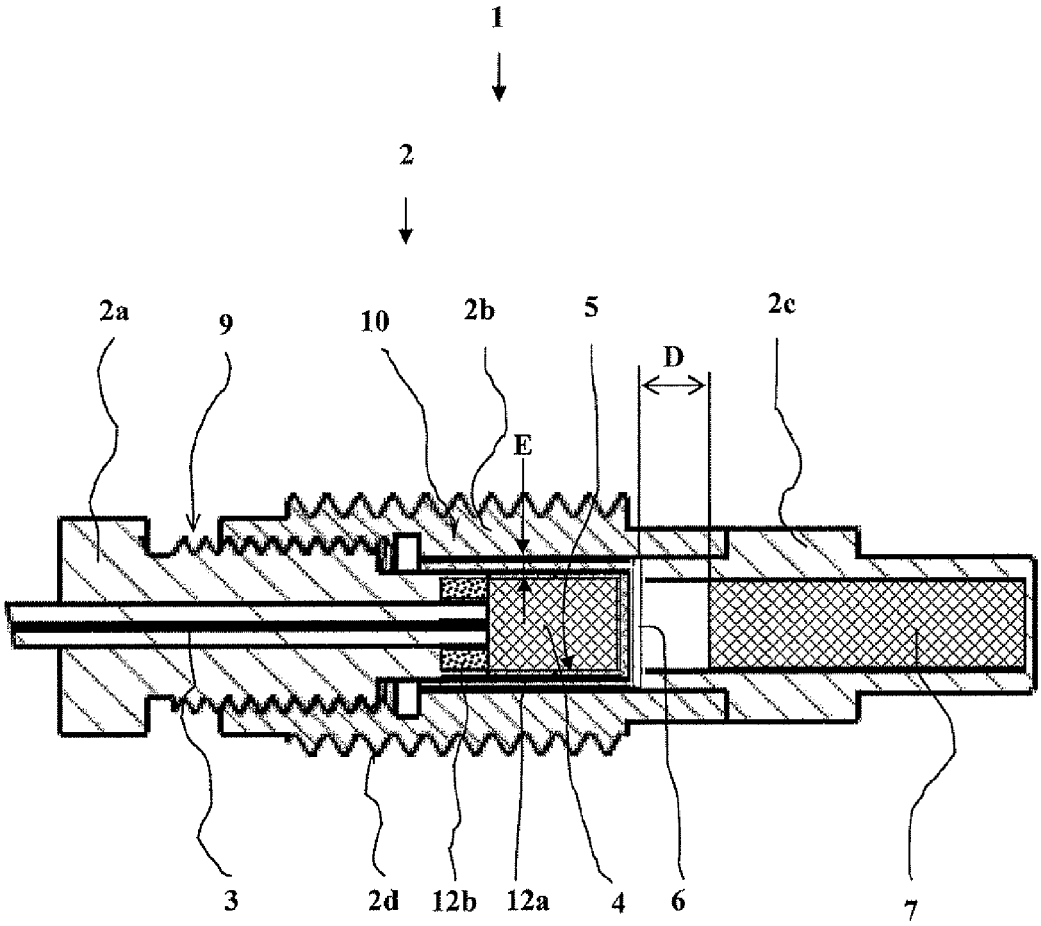
FIG. 2 is a view in longitudinal section of a detonator according to a second embodiment of the invention.

Thus, the one skilled in the art will determine the minimum thickness E (thickness which may range from 0.5 to 2 mm, thickness is best seen in FIG. 2) of the insulation means 12 to ensure a sufficient time offset between the reach of a given temperature level outside and the reach of the same level inside the insulation means 12.

The thickness will be selected so that there is a time offset of at least 30 seconds between the time when the temperature outside the insulation means 12 is of 230° C. and the time when the temperature inside the insulation means 12 is of 230° C.

In fire conditions such as previously mentioned and for the above-mentioned materials and compositions and for the appropriate insulation thickness, beyond 30 seconds, the secondary pyrotechnic composition 7 has indeed decomposed.

Since the primary pyrotechnic composition 4 is protected during this interval by the thermal insulation means, it does not react. Beyond the 30 seconds, it may then react without fear of triggering a detonation.

Different variants are possible without departing from the scope of the invention. For instance, according to FIG. 2, the thermal insulation means may associate an envelope 12*a* made of a first thermal insulation material and closed by a plug 12*b* made of a second thermal insulation material.

The envelope 12*a* receiving the pyrotechnic composition may for example be made of ceramic material and the plug 12*b* may be made of plastic. Since ceramic is very fragile, the use of a plastic plug allows to close the assembly without any risk of cracking.

Other embodiments are possible, the loaded casing 5, or directly its load of secondary explosive 4 when no casing is used (explosive tolerating a compressibility of less than 45 MPa, for example), may be covered with ceramic by sintering for example.

The invention has been described with a squib stage initiated by an optical fiber, but the invention may also be implemented with a squib stage initiated in a more conventional way by electrical energy, for example a hot wire- or exploding wire-squib.

The invention claimed is:

1. A detonator comprising a flying plate propelled by a bottom of a squib stage comprising at least one first pyrotechnic composition and/or one first explosive, said plate being propelled onto a relay stage comprising at least one secondary explosive, said detonator being provided with thermal insulation means surrounding the squib stage and covering the bottom of the squib stage for delaying the temperature rise thereof, wherein said thermal insulation means comprises one or more materials and the one or more materials constituting the thermal insulation means exhibit a thermal conductivity of less than or equal to 0.24 $W \cdot m^{-1} \cdot K^{-1}$.

2. The detonator comprising a flying plate according to claim 1, wherein the thermal insulation means is provided with an envelope made of a ceramic material.

3. The detonator comprising a flying plate according to claim 1, wherein the thermal insulation means is provided with an envelope made of a plastic or composite material.

4. The detonator comprising a flying plate according to claim 1, wherein the thermal insulation means comprises an envelope made of a first thermal insulation material and closed by a plug made of a second thermal insulation material.

5. The detonator comprising a flying plate according to claim 1, wherein the thickness of the thermal insulation means is greater than 0.5 mm.

6. The detonator comprising a flying plate according to claim 1, wherein the first pyrotechnic composition or the first explosive of the squib stage is in contact with the end of an optical fiber.

* * * * *